US006418279B1

(12) United States Patent
Weinberger et al.

(10) Patent No.: US 6,418,279 B1
(45) Date of Patent: Jul. 9, 2002

(54) PAPER PROCESSING SYSTEM

(75) Inventors: Joseph Weinberger, East Brunswick, NJ (US); Stefan G. Golicz, Centerbrook; William H. Webb, Jr., Old Saybrook, both of CT (US)

(73) Assignee: The Weinberger Group, LLC, East Brunswick, NJ (US)

( * ) Notice: Subject to any disclaimer, the term of this patent is extended or adjusted under 35 U.S.C. 154(b) by 0 days.

(21) Appl. No.: 09/514,612

(22) Filed: Feb. 28, 2000

(51) Int. Cl.[7] ..... G03G 15/00

(52) U.S. Cl. ..... 399/2; 347/3; 358/496; 399/367

(58) Field of Search ..... 399/366, 194, 399/365, 367, 374, 1, 2, 6, 7; 358/494, 496, 300; 347/2, 3, 4

(56) References Cited

U.S. PATENT DOCUMENTS

| | | | | |
|---|---|---|---|---|
| 4,551,008 A | * | 11/1985 | Banton | 399/4 |
| 4,731,639 A | * | 3/1988 | Gutmann et al. | 355/64 |
| 4,772,004 A | | 9/1988 | Golicz | |
| 4,901,158 A | * | 2/1990 | Sato et al. | 358/296 |
| 4,909,499 A | | 3/1990 | O'Brien et al. | |
| 5,033,729 A | | 7/1991 | Struthers | |
| 5,038,182 A | * | 8/1991 | Tanimoto | 399/374 |
| 5,335,899 A | | 8/1994 | Golicz | |
| 5,342,036 A | | 8/1994 | Golicz | |
| 5,373,350 A | * | 12/1994 | Taylor et al. | 399/2 |
| 5,497,250 A | * | 3/1996 | Kawashima | 358/498 |
| 5,601,018 A | * | 2/1997 | Iimura et al. | 101/45 |
| 5,613,674 A | | 3/1997 | Golicz et al. | |
| 5,659,403 A | * | 8/1997 | Itoigawa | 358/474 |
| 6,067,170 A | * | 5/2000 | Kawashima et al. | 358/405 |

FOREIGN PATENT DOCUMENTS

| | | | |
|---|---|---|---|
| JP | 62-201473 | * | 9/1987 |
| JP | 62-245774 | * | 10/1987 |
| JP | 08-018767 | * | 1/1996 |

OTHER PUBLICATIONS

Videojet® brochure, "Jetstream® II Imaging System", ©1990 Videojet Systems International, Inc.
Videojet® brochure, "Videojet 37plus Ink Jet Imager", ©1998 Videojet Systems International, Inc.
Videojet® brochure, "Videojet PrintPro ES™ Digital Imaging System", ©1997 Videojet Systems International, Inc.
Videojet® brochure, "Cheshire© 4000 Imaging System", ©1998 Videojet Systems International, Inc.
Videojet® corporate brochure—VCB–0597–5M–US.
Videojet® brochure, "Excel and 37 Series Print Sample Guide", ©1997 Videojet Systems International, Inc.

* cited by examiner

*Primary Examiner*—Robert Beatty
(74) *Attorney, Agent, or Firm*—Hedman & Costigan, P.C.

(57) ABSTRACT

A paper processing device for marking original documents including a document feeder having a document singulation section, a printer for printing user determinable annotations on the document, an inverter to turn the document onto its first side and a stacker to stack the printed documents in their original order wherein printing the annotation is controlled by a print control computer. Preferably, the device includes a justifier for bringing the documents to a standard edge on which the printing is performed. The device also optionally includes a second side detector and a second printer for marking the second side of documents processed.

23 Claims, 6 Drawing Sheets

PAPER PROCESSING SYSTEM

FIELD OF THE INVENTION

The present invention relates to a paper processing device for printing or marking documents.

BACKGROUND OF THE INVENTION

The stamping, marking, printing or pagination of documents has been done in a limited number of ways. Original documents are most commonly marked with a manual Bates Stamp device consisting of a handle, a rubber or synthetic stamp and an inking pad. The rubber stamp is pushed down onto the document by depressing the handle. When the stamp lifts off of the document, the print pad automatically advances to the next consecutive number and is brought into contact with the inking pad. The user then flips to the next document by hand and manually depresses the handle down to contact the rubber stamp on the document.

Another method utilizes stickers which are sequentially numbered. The user manually releases the stickers from a preprinted sheet and sticks them onto documents, manually flipping over the documents once the sticker has been applied.

Automatic means have included passing original documents through a copy machine where the copy machine masks out a portion of the copy and inserts the stamp or mark. Thus, the stamp or mark does not appear on the original document but appears only on the copy (see U.S. Pat. No. 4,712,907 to Weinberger).

SUMMARY OF THE INVENTION

Deficiencies in the prior art are overcome by the present invention which is directed to a paper processing device comprising a document feeder, at least one print means for printing user determinable annotations on the documents, a print control computer for controlling the user determinable input and a stacker. A justifier is preferably included to provide a standardized edge for printing.

The invention provides that original documents can be individually fed into the device, justified to one edge, preferably the edge where user determinable annotations are to be printed, and stamped, marked or printed with a user determined annotation. Documents which have been so marked are then stacked in the order they are fed for removal from the device.

In its preferred embodiment, the device includes a second side print means for printing on the second side of a document. Most preferably, a second side detector, which optically scans the opposite side of a document to determine if there is printed material thereon, is used to determine when the second side should be printed on, as generally described in the patent application filed on Feb. 25, 2000 naming Joseph Weinberger and William Webb as inventors, claiming priority on Provisional Application No. 60/121,717.

It is preferred that a device with second side detect and printing means includes an inverter to turn the document over prior to printing on the opposite side. This further provides for stacking the processed documents in the original order that they are fed.

The print control computer provides that the various annotations for marking or stamping can be programmed by the operator. Thus, a job can be programmed with a series of words or numbers, interrupted with a different job, and later resumed where it was left off. To facilitate such interaction, a user keyboard and display are preferably incorporated to allow the user to control the stamps or marks being printed.

It is also preferred that a bar code reader be added for reading instructions for withholding a stamp on the sheet with a bar code. Such sheets can be used to designate, inter alia, when a group of documents should be stapled. The bar code sheet can be passed over for stamping to maintain sequential numbering of the documents.

In its most preferred embodiment, the device also includes one or more scanners to scan the images of the documents being marked. Storage means, such as a hard disc, floppy disc or writable CD would preferably be associated with the device to store the scanned images either as part of the device or external thereto. Similarly, the scanner can be associated with an external printer for printing the marked images.

Additional printing means can also be added as an option if the user desires that certain documents have a printed watermark or overstrike such as "CONFIDENTIAL" or the like.

Also disclosed is a paper processing device having first and second print heads directed over the entire first and second sides of a page to use the device as a two-sided printer.

BRIEF DESCRIPTION OF THE DRAWINGS

The attached drawings, in which like reference characters indicate like parts, are included solely to illustrate a preferred embodiment of the present invention without limiting the invention in any manner whatsoever.

DETAILED DESCRIPTION OF THE PREFERRED EMBODIMENT

Figure 1:
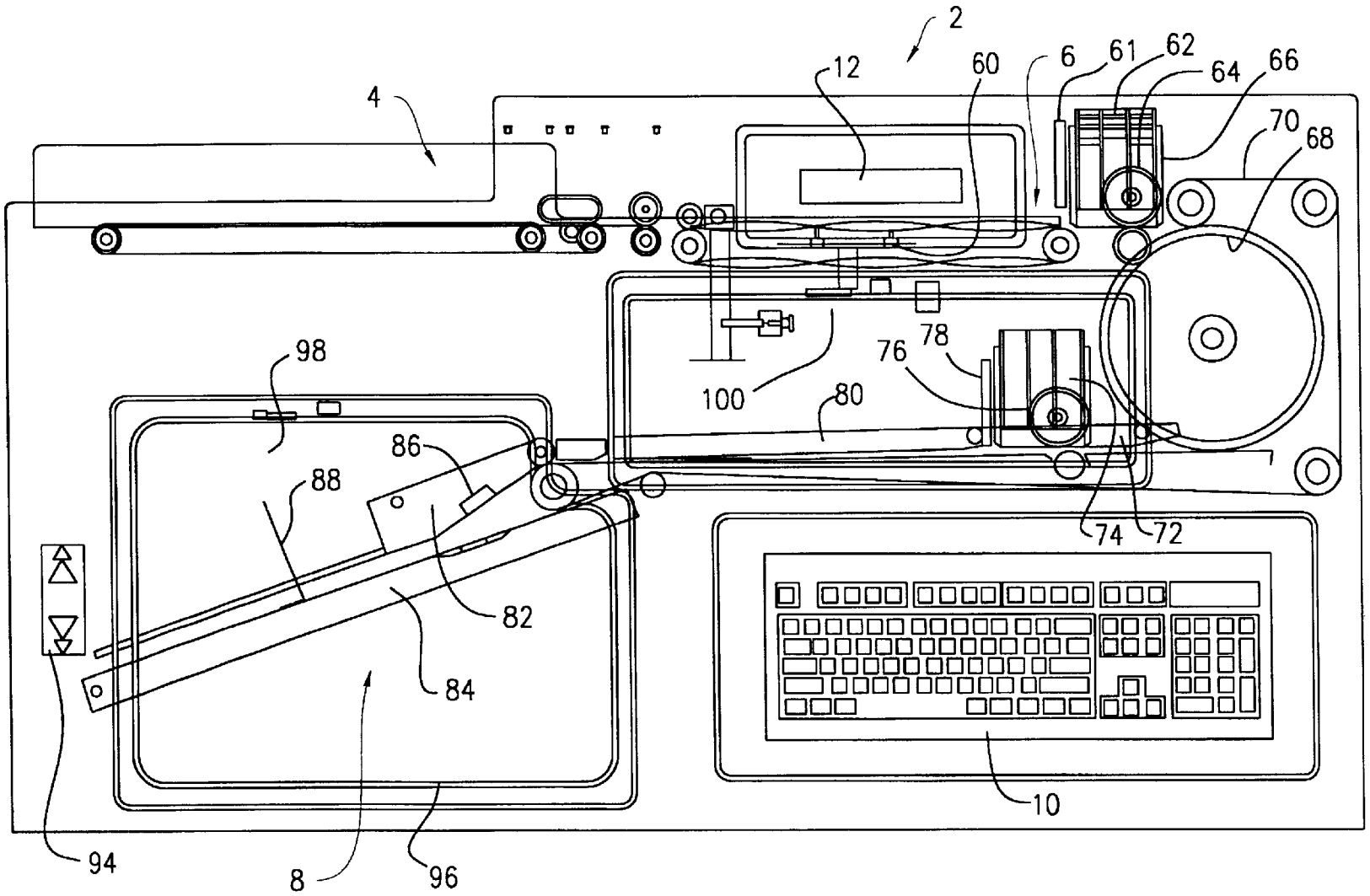
FIG. 1 is a schematic elevation of the device of the present invention.

The device 2 of the present invention, as best seen in FIG. 1, comprises a series of progressive interactive sections. Generally, a stack of original documents placed in the feeder section 4 are singularly passed to the justifier section 6 where the edge of the documents are justified for printing. After printing, the document is inverted transported to the stacker section 8 where the documents are restacked face down in their original order.

The device 2 includes a printing and data entry control computer (not shown) where a user can program a job or jobs to be processed by inputting annotation information. The user preferably interfaces with the control computer using data entry keyboard 10 and an LCD display 12 for data entry and prompts. In this manner the user can input information to be printed, such as "Attorney Client Privilege", "Confidential", "Defendant", "Plaintiff", a case name and/or a Bates number to begin a job. With respect to the Bates number, it is anticipated that the computer can process and store several jobs at once. This provides that one job can be interrupted with a different job and then the original job can be recalled and restarted at the place where it left off.

For purposes of mobility and use, the keyboard 10 is preferably pivotably mounted so that it can be pivoted from a stored position, vertical against the wall of the device 2 for transport, to a use position, substantially horizontal to the device 2, using shelf brackets or the like.

The feeder section 4 can be any known type of feeder as presently used on imaging machine such as printers, facsimile machines, copiers, scanners and the like. Preferred, however, is a feeder of the type disclosed in U.S. Pat. No. 4,772,004.

Figure 3:
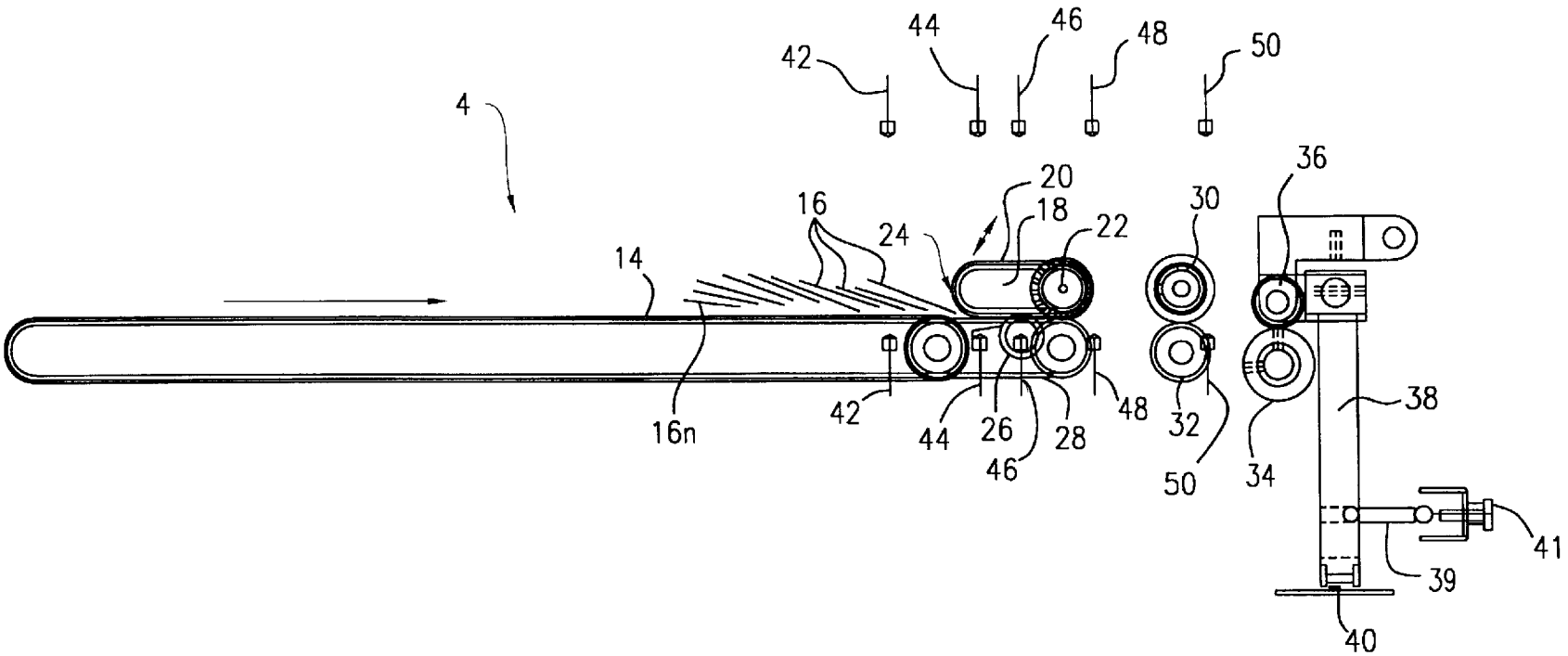
FIG. 3 is a schematic view of the feeder section of the device of the present invention.

The preferred feeder section 4, shown in FIG. 3, includes a driven supply belt 14 onto which the documents 16 are stacked, fanned out rearwardly under the first document, face up. This allows a user to provide a continuous resupply of new documents on the back of the supply belt by lifting the trailing document 16*n* and slipping the first of an additional stack thereunder. An adjustable guide is used to maintain the documents 16 substantially against the operator edge of the feeder portion 4.

The supply belt 14 can be any length, depending on the size of the stack contemplated, with longer belts accommodating a larger capacity of documents 16. The supply belt 14, however, should not be less than about 12" long to accommodate a stack of 8½" wide paper, and is preferably about 18 to about 20 inches long.

The supply belt 14 advances the documents 16 to a driven elongated prompter 18 having a ribbed prompter belt 20, fixed pivot point 22 and the ability to tilt upwardly at the leading edge 24 so that it can contour to the angle of large stacks of documents 16. A spring (not shown) keeps downward tension on the leading edge 24 of the prompter 18. A user adjustment maintains two pull out rollers parallel to the prompter belt 20 to eliminate skewing of the documents 16.

Below the prompter 18 is a retard roller 26 having a friction brake which creates a snub angle to separate adjacent documents 16. In the area of the retard roller 26, also to aid in separation of adjacent documents 16, is a singulator belt 28 which is not driven but has a clutch so that it can only turn forward, not backward.

To further ensure that only single documents pass through for printing, a driven caliper roller 30 is preferably placed directly over a fixed caliper stone 32. The caliper stone 32 is mounted solid to provide friction to the bottom document 16. The driven caliper roller 30 is preferably rubber or a similar material. The gap between the caliper roller 30 and caliper stone is approximately 1½ times the thickness of 1 sheet.

The caliper roller 30 is preferably mounted on a shaft wherein one side of the shaft is fixed and the other side is spring mounted to allow for user adjustments of the caliper roller 30 angle. Proper alignment of the caliper roller 30 to the caliper stone is preferred to eliminate skewing of the document passing therethrough.

A feed discharge nip is provided at the end of the feeder section 4 which comprises lower driven rubber discharge rollers 34 with spring loaded idle rollers 36 above. The spring loaded idle roller 36 maintains a weight on the document 16 against the discharge roller 34 and is operatively connected to an extension arm 38 which acts as a mechanical amplifier. The extension arm 38 preferably extends downwardly over about 5–6 inches to cooperate with a magnetic or hall effect double detect sensor 40. An adjustable tension spring 39 cooperates with the extension arm to maintain proper positioning of the extension arm 38 when idle. This arrangement acts as a double sheet detect wherein when the distance between the discharge roller 34 and idle roller 36 is too great the extension arm 38 moves and is picked up by the magnetic double detect sensor 40.

Other sensors are preferably used in the feeder section 4 to efficiently process the documents 16. A paper out sensor 42 detects if there are no more documents 16 on the supply belt 14. A fast speed supply sensor 44 is followed by a slow speed supply sensor 46 which work together to properly bring documents 16 up to the prompter 18. Therefore, if no documents are detected by the fast speed supply sensor 44 the supply belt 14 is moved faster to get the documents 16 to the prompter 18. However, if the fast speed supply sensor 44 is covered, the documents 16 are brought up at a slower speed.

A feed sensor 48 and discharge sensor 50 work to control the sequencing of documents 16 being processed. When a document 16 reaches the discharge sensor 50, it turns off the prompter clutch (not shown) but leaves the caliper roller 30 driven until the document 16 reaches the discharge rollers 34. When the document 16 reaches the discharge rollers 34, the clutch for the caliper roller 30 is turned off. Not until the feed sensor 48 shows that the area is clear are both the prompter clutch and caliper roller clutch turned on again. As such, the feed sensor 48 ensures the smallest gap between successive document sheets 16 processed.

Figure 4:
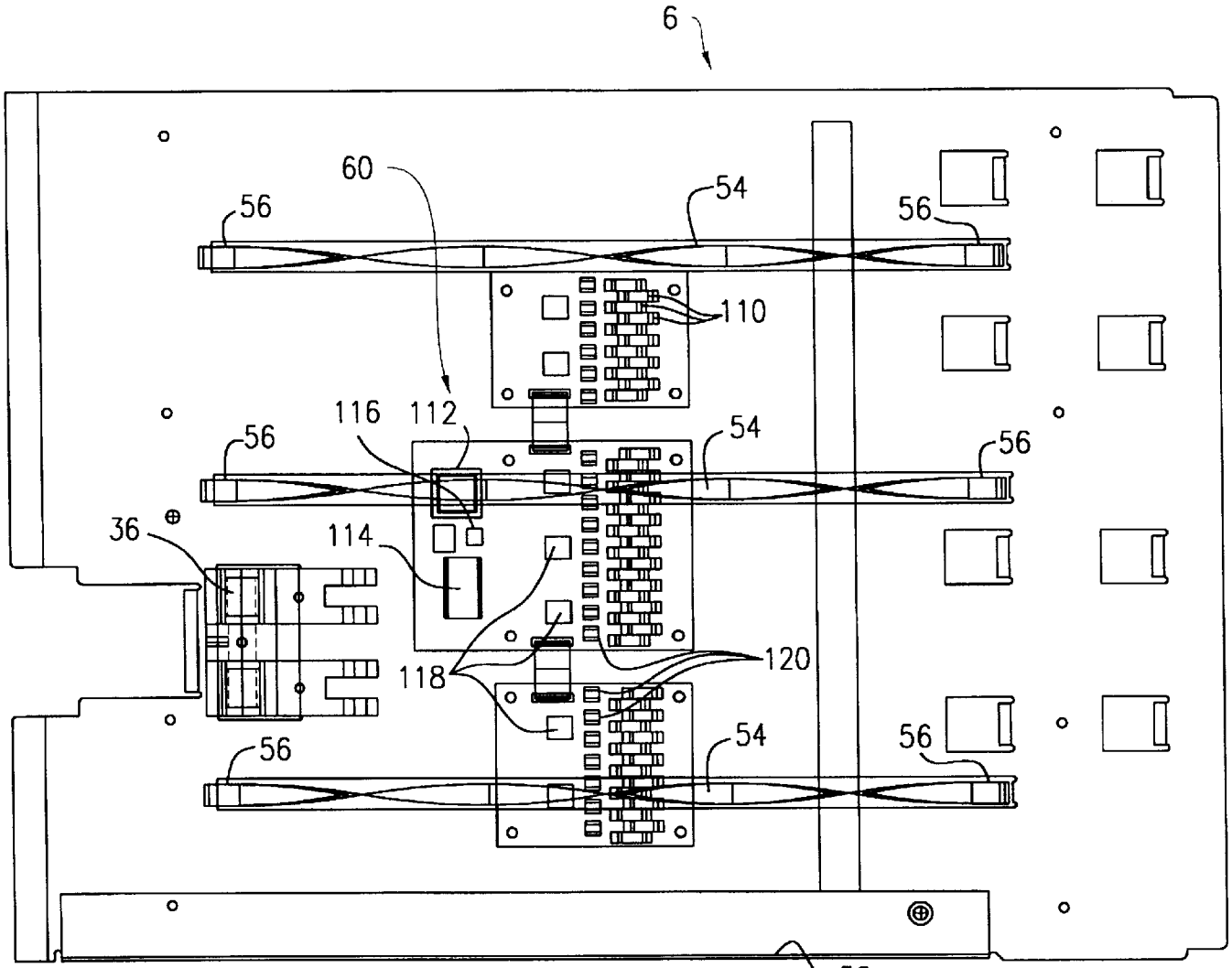
FIG. 4 is a plan view of the justifier section of the present invention.

Documents 16 passed out of the feeder section 4 move to the justifier section 6, best shown in FIG. 4. In the justifier section 6 the documents 16 are brought into contact with a guide rail 52. Although any justifying mechanism can be used, the preferred justifier is similar to the type described in U.S. Pat. No. 5,613,674. This preferred justifier uses at least one elastomeric band 54 having at least one twist on a top surface placed around parallel rollers 56. The elastomeric bands 54 move the documents 16 forward and toward the guide rail 52. A vacuum fan (not shown) is preferably used to hold the documents to the elastomeric band(s) 54.

Most preferably, the justifier section 6 has an image detect system incorporating a second side detection means 60. The second side detect means 60 of the present invention preferably utilizes reflective sensors to optically scan the bottom or "second side" of the document 16 for determining whether markings appear thereon. If markings do appear from the second side detection means 60, the paginator 2 arranges for pagination on the second side through the use of a second side print mechanism, discussed below.

This second side detection means 60 preferably consists of an Intel 8051 series microprocessor 112 with memory and address decoding components used to monitor and interpret the voltage levels from reflective type infrared sensors 110. Infrared light is projected onto the back side of the paper being fed and reflected back to a photo transistor 110 that is sensitive to infrared light. The amount of light reflected is proportional to the albedo of the reflecting surface and therefore the voltage received by the analog to digital converter is proportional also. Blank paper would be very reflective where markings or images on the paper would absorb the infrared light.

The Intel 8051 series microprocessor 112 with memory 114 and address decoding 116 components polls the sensors 110 whose voltage output is fed into analog to digital converters 118. The sensor sensitivity levels are set by digital potentiometers 120 controlled by an 12C bus. During calibration the main control computer is linked with this second side detect computer 112, preferably using a serial port. The actual voltage levels can be seen and set at this time.

In addition, voltage comparators (not shown) similar to the National LM339IC can be used to speed up processing of the second side detection circuit. The output of the sensors 110 would be sent to the comparators having a preset level. If the preset level is exceeded the comparators can almost instantaneously provide a second side process signal for the processor 112 to pick up.

In the run mode the second side detect control computer software in the microprocessor 112 determines whether or not marks or images have been detected on the second side. A valid detection is converted into a TTL output sent from the second side detect computer 112 and received by the image processing device main control TTL input port. The main computer responds accordingly and instructs the second side of the document to be processed.

As the document 16 leaves the justifier section 6, the document 16 passes a bar code reader 61 which provides instructions to refrain from printing a particular document in certain instances. For example, when paginating documents, staples are taken out, often a "start staple" and "stop staple" insert is placed at the beginning and end of the group of documents which were stapled to allow a user to put the documents back into their original form. The start and stop staple inserts generally have bar codes printed on them to ensure that they are not paginated, since they were not part of the original documents and would cause gaps in the serial pagination.

The bar code reader 61 determines whether a bar code exists on a particular sheet and, if so, instructs the print head 62 not to put the annotation on that sheet. Thus, the original documents retain a succession of numbers without gaps for the inserts.

After the bar code reader 61 scans the document 16 it passes beneath the first print head 62. Although the print means 62 can comprise a manual stamp pad, a laser printer, electrostatic charge or any method of printing known or later developed, an ink jet printer is preferred. The ink jet print head 62 is mounted on a track so that it can move across the document 16 for full page printing or can be located in a stationary position, preferably in the area of the justified edge. For application as a paginator or annotator, it is preferred that the print head 62 provide either one line printing, with letters of about ¼" in height, or two line printing, with letters of about ⅛" in height, along the entire edge of the document and multiple colors, if desired.

Two parallel sets of upper print head pinch rollers are used to guide the paper past the first print head 62. Driven lower pinch rollers are located beneath the document 16 with corresponding spring loaded upper rollers to pinch the document 16 therebetween. The driven lower pinch rollers are on one way clutches so that if there is a speed differential in the two parallel sets of rollers, the clutch can compensate to ensure that the document 16 is not skewed.

An encoder 64 is used in the area of the print head 62 to record the velocity of the document, so as to ensure proper printing of the indicia or annotation. The encoder 64 has a segmented disc which measures distance thereby permitting the print head 62 to properly space the print pixels in relation to the speed of the document 16.

It is also contemplated that a separate printed watermark/overstrike print head can be placed in the area of the first print head 62 to provide a printed watermark or overstrike across the middle of the document 16, if desired by the user. The printed watermark or overstrike can be a half-tone or gray mark which reads "confidential", "privileged" or any other words or designs as input by the user.

In its most preferred embodiment, a first scanner 66 is placed immediately downstream of the first print head 62. This allows for the documents to be scanned for digital or electronic entry onto storage means, such as a hard drive or onto a recording medium such as a floppy disc or a writable CD without the need for an additional scanning step. The storage means can be internal to the device 2 or external.

Figure 2:
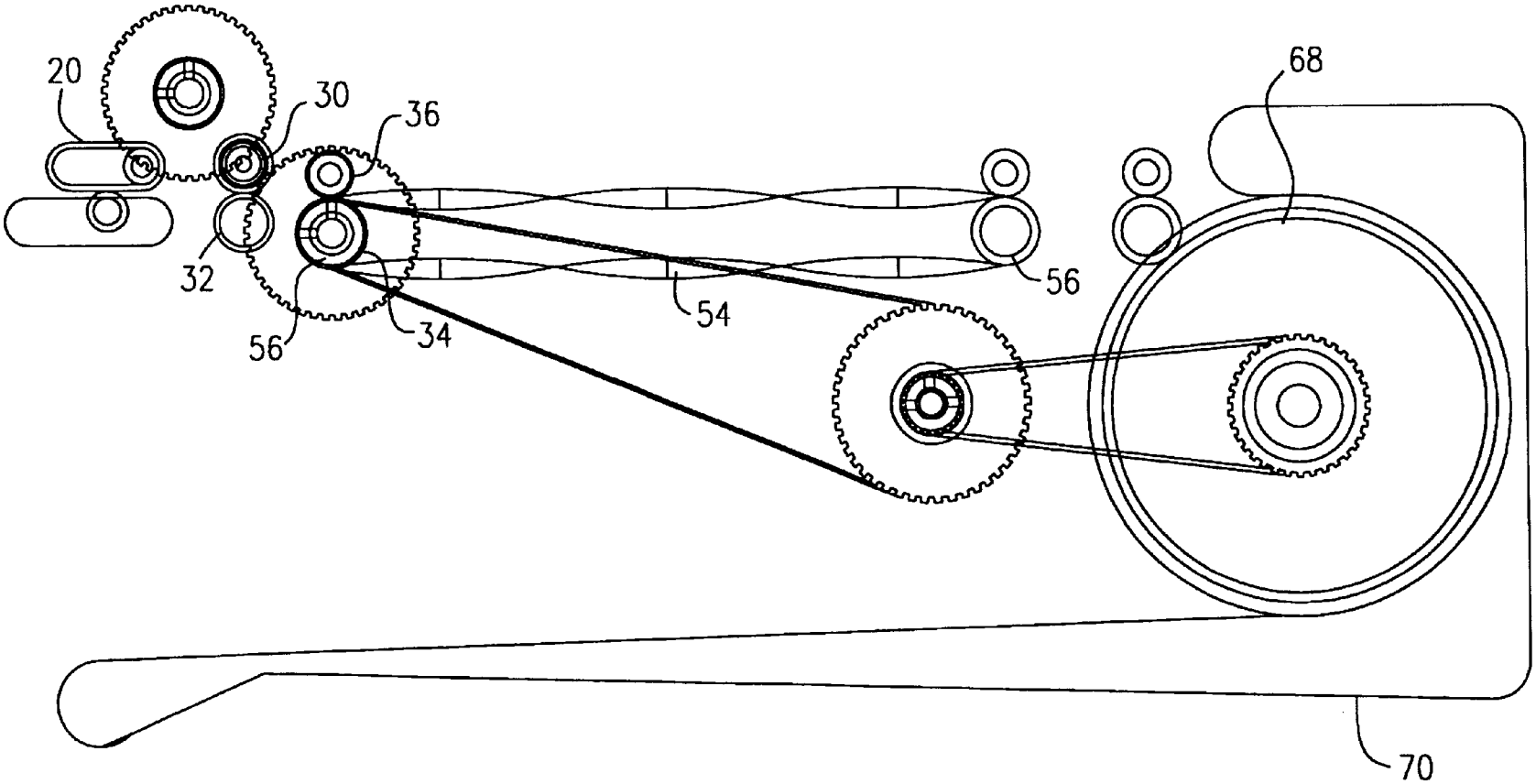
FIG. 2 is a schematic elevation of the drive elements of the device of the present invention.

The document 16 with the printed indicia is then inverted, preferably using an inverter drum 68 driven by a plurality of continuous elastomeric transport belts 70 (see FIG. 2). The inverter drum 68 is preferably mounted on a flange bearing, externally self aligning, having a lubrication fitting. The transport belts 70 hold the document 16 to the drum 68 and maintain the justification of the document 16. The preferred transport belts 70 are semi-conductive for dissipation of static electricity.

The transport belts 70 preferably transport the document 16 through the remainder of the device 2, into the stacker section 8. In its most preferred embodiment, there are three transport belts 70. On belt 70 is near the justified edge of the inverter drum 68, one is at about 10 inches from the justified edge (corresponding to an 8½×11" document) and one intermediate these belts, the intermediate belt being most significant in maintaining justification and holding the document to the drum. The transport belts 70 are on return guide rollers (not shown) to keep them on the inverter drum 68.

The size of the inverter drum 68 is not particularly significant to the present invention as long as it is suitable to effectively perform the inverter function. In its preferred embodiment, however, an inverter drum 68 having a surface circumference of about 25 inches is contemplated in part to provide room inside the drum 68 for auxiliary functions. For example, a clear inverter drum 68 can be used with a scanner or second side sensor mounted therein to perform scanning and/or second side detect functions.

As the document 16 leaves the inverter drum 68, it passes beneath a first lower guide 72 and under a second print means 74 for printing the user designated annotation on the second side of a document 16, if two-sided printing is selected by the user or if the second side sensor 60 has detected markings thereon. As with the first print head 62, a second print head encoder 76 is used to ensure proper pixel alignment during printing at various document transport speeds. Also, as with the first print head 62, the second print head 74 is mounted on a bar and is movable to provide full printing across the document when used merely as a two-sided printer.

If no markings have been detected, and automatic second side printing and/or marking has not been user selected, the second side will not receive printing. Significantly, in the pagination process described herein, the second side printing will maintain the order of the documents 16 by printing the next serial number after the number on the first side of the same document 16 when serialized indicia has been programmed.

A second side scanner 78 follows the second print head 74 to scan the second side of the document 16 having markings thereon for storage on a storage medium. As with the second print head 74, the second side scanner 78 only scans the image if marks have been detected on the second side or if second side scanning has been user selected.

After the document leaves the second side print/scanner area, the transport belt 70 preferably passes the document 16 along to the stacker section 8. The document 16 is preferably pressed against the transport belt 70 through roller balls mounted on a second lower guide plate 80. The second lower guide plate 80 is preferably movable to provide user access in the event of a paper a jam in the area.

As the document 16 leaves the transport belt 16 it is fed into the stacker section 8 where a deflector guard 82 resting above a document stacker platen 84 directs the incoming document 16 onto the stacker platen 84. Preferably, the deflector 82 includes one or more fans 86 to force the document 16 down onto the stack, thereby reducing jams and/or errors in the document sequence.

The stacker platen 84 is preferably inclined with the leading edge lower than the trailing edge. An adjustable stop 88 is movably attached to the stacker platen 84, wherein the stop 88 can be adjusted based on the width of the documents being processed. The adjustment of the stop 88 can be manually set by the user or automatically adjustable based on the determination of the document width at the feeder sensors.

The stacker platen 84 is also preferably movable so that the height drops based on the height of the stack of the documents 16 thereon. The height of the stacker platen 84 is preferably automatically adjusted by servo motors upon information received from photo sensors which detect the uppermost level of the stack. As the stack grows, the stacker platen 84 lowers or, if too low, rises. The preferred arrangement includes a stack too high photo sensor 90 and a stack too low photo sensor 92.

The weight of the stacking mechanism is preferably zero balanced on negate springs, preferably on each side of the stacker platen 84, so that the stacker platen 84 lowers evenly at the inclined angle as the stack grows. This is generally shown as the difference between configuration A and configuration B in FIG. 5A.

Figure 5:
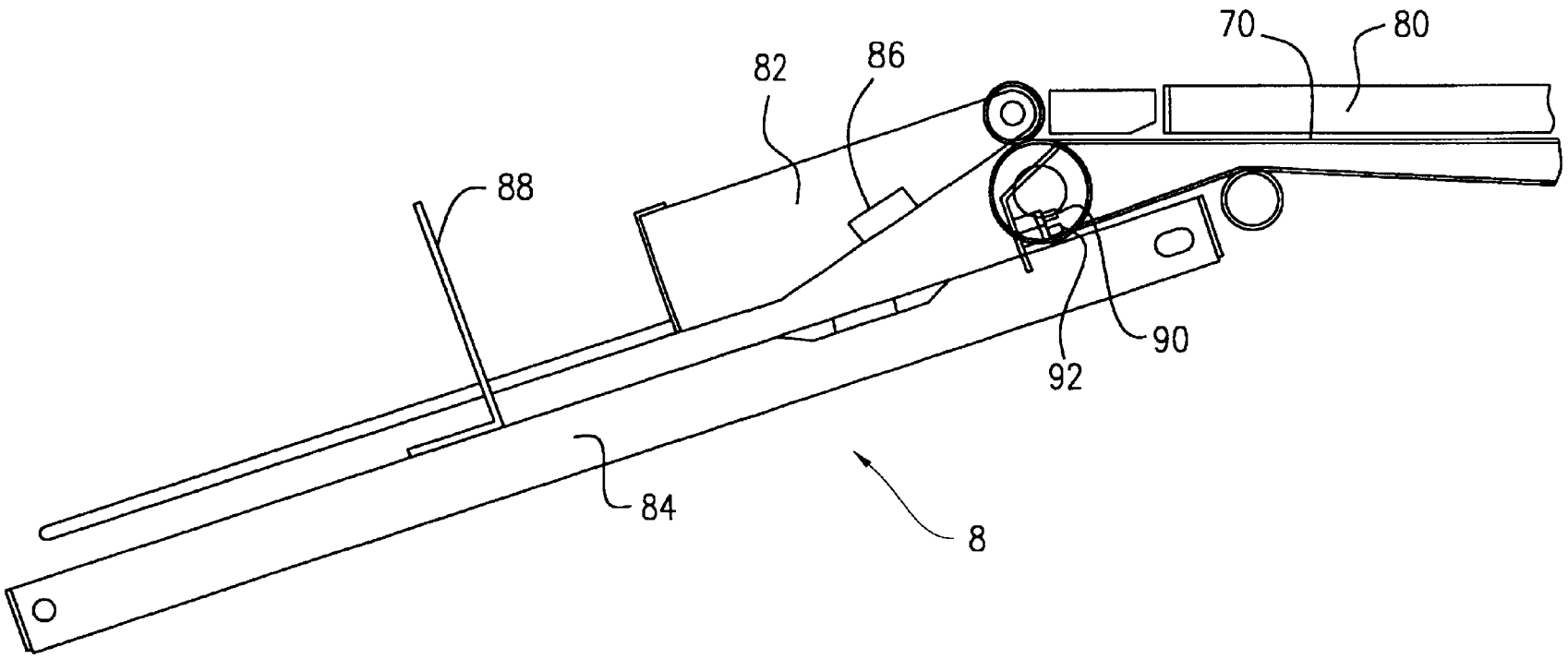
FIG. 5 is an elevation view of the stacker section of the present invention.
Figure 5A:
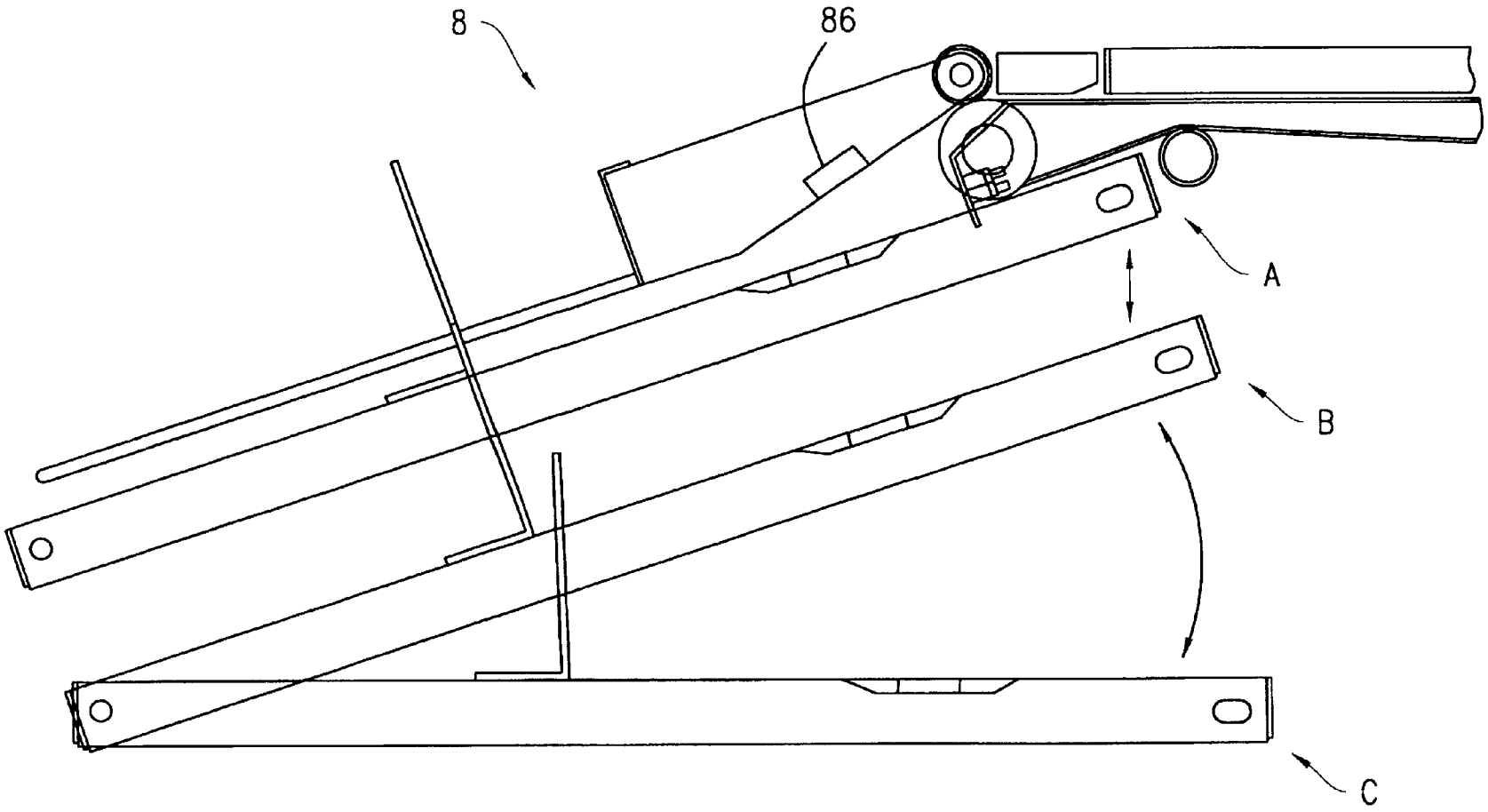
FIG. 5A is an elevation view of the stacker section moving from its stacking position (A), to its dropped position (B), to its user interactive position (C).

When the stacker platen 84 is full, or when a user wishes to drop the platen 84 manually for unloading using the stack control switch 94, the stacker platen 84 lowers and pivots to substantially horizontal (configuration C in FIG. 5A). This facilitates user interaction with the device 2 by providing ease of removal of a document stack through the stack opening 96, preferably covered by a door 98 when the stack is not being accessed. Sensors are used so that the paginator 2 will not run when the stacker door 98 is open or when the stacker platen 84 is not in its raised, inclined position (configurations A–B in FIG. 5A). Similarly, sensors prohibit the device 2 from running when there is an error in processing or when the stacker platen 84 is full.

The driven parts, i.e., the inverter drum 68, the parallel roller 56, the discharge rollers 34, etc., are driven via a main drive motor (not shown). The main drive motor is preferably an AC variable speed 3 phase motor with AC inverter for speed control. A General Electric model no. 5K33GN2A has been found to be well suited for this application with a variable switch to control the speed of the documents being processed. In the preferred processing device 2 the variable processing speed is from about 50 to about 300 sheets per minute. All drive and idler shafts are journaled on ball bearings on gears. The size of the gears and belts from the drive motor determine the speed of the various driven parts.

The power cord to the power supply is preferably fused with a capacitor to reduce noise. The power supply which runs the mechanical functions of the device 2 preferably provides +5, +12, −12 and +24 volts. A second power supply directed solely to the first and second print heads 62 and 74 produces 12.7v at 10 amps.

A transformer, bridge rectifier and capacitor control step motors for moving the stacker surface 84 up and down.

Additionally, the preferred device 2 includes a cost accounting port to allow a user to keep track of the number of documents processed to a particular client for billing purposes using accounting systems generally available from such suppliers as COPYTRACK, EQUITRAC and INFORTEXT.

In addition to the print control computer having data input means, the device 2 of the present invention includes a device control computer. The device control computer ensures proper functioning of the machine by controlling the timing of the document transport actions through the use of sensors preferably in the feed section (as described above), at the first print head 62, at the second print head and in the stacker section 8.

Significantly, when an error such as a paper jam occurs in one area, the device control computer receives input from the applicable sensor but allows the device to continue running downstream of the affected area. This feature provides that unaffected documents will be passed through the remainder of the device 2 for completion of processing without being stopped by an error which is upstream of, and does not affect, the particular document.

Thus, if a jam is detected in the feed section 4, the document associated with the error will stop but documents in the justifier section 6 and downstream will continue to be printed and passed through to the stack. To enable this feature, clutches are used at the feeder section 4 to stop the driven devices in the feed section 4 without stopping the drive to the downstream driven devices.

It is also preferred that in addition to the print control display 12, there is an error display viewable by the user to determine the location of an error. It is preferred that the error display is separate from the print display 12 and may comprise nothing more than indicator lights on a device overlay relating to various parts of the paginator. As such, if the light behind the second print head 74 is illuminated, the user knows that an error occurred in that location.

It is further preferred that the device 2 include a separate diagnostic display for use by service technicians. This display is to provide useful information regarding machine function, error history, etc. for assisting in repairs. The diagnostic display is preferably not in an area for user viewing since it is contemplated to display only technician information.

The device 2 is preferably built on a sheet metal frame with a slide out chassis to service the major internal components, such as the transport belt 70, inverter drum 68, second side print heads 74 and second side scanner 78, etc. Preferably, the electrical components are arranged in a Faraday cage and an internal fan draws air across the motor and pushes the air over the power supplies, processing boards and out of the device to cool the components. A fan capable of moving 103 cu.ft./min. has been found suitable for this purpose.

The device 2 is preferably covered with panels made of aluminum, impact resistant ABS plastic or, most preferably, V94 Kydex (self-extinguishing plastic). As described above, a stack access door 98 is provided to access the documents 16 in the stacker section 8 and a lower transport access door 100 preferably covers the lower print head 74/transport area for the user to clear jams, etc.

Of course, variations, modification and changes to the present invention will make themselves apparent to one skilled in the are reading the present disclosure. All such modifications, variations and changes are intended to fall within the scope of the present invention limited only by the appended claims.

All patents and publications referred to herein are hereby incorporated by reference.

What is claimed is:

1. A paper processing device for printing original documents with user determinable annotations comprising a document feeder, print means for printing the user determined annotation onto the document downstream of the document feeder, an inverter to turn the document onto its first side downstream of the print means, and a stacker to stack the printed documents in their original order downstream of the inverter, wherein the annotation printing is controlled by a print control computer.

2. The device of claim 1 wherein the feeder comprises a supply belt for advancing the stack of documents to a singulator section.

3. The device of claim 1 wherein the feeder includes a singulator section having at least one singulation means for separating single documents from a stack of documents.

4. The device of claim 3 further comprising a double detector downstream of the singulator section for signaling the presence of more than one document passing therethrough.

5. The device of claim 3 further comprising a feed sensor after singulation for determining when a single document has passed.

6. The device of claim 1 further comprising a justifier for justifying an edge of the documents for printing.

7. The device of claim 6 wherein the justifier comprises a guide rail and at least one elastomeric band set between rollers with at least one twist on a surface of the elastomeric band which engages the documents, the elastomeric band directing the documents downstream and toward the guide rail.

8. The device of claim 1 further comprising a second side detector for the detection of markings on the second side of a document being processed.

9. The device of claim 8 wherein the second side detector utilizes a series of infrared sensors for measuring infrared light reflected from the second side of the document.

10. The device of claim 1 wherein the print means is taken from the group consisting of ink jet, laser, dot matrix, electrostatic and physical stamp.

11. The device of claim 10 wherein the print means is an ink jet printer.

12. The device of claim 11 wherein the ink jet printer includes multiple colors.

13. The device of claim 11 further comprising an encoder associated with the ink jet printer to properly space the printing on a moving document.

14. The device of claim 1 wherein the inverter comprises an inverter drum engaged by one or more transport belts for advancing the document.

15. The device of claim 1 further comprising at least a second print means downstream of the inverter for printing on the second side of a document.

16. The device of claim 15 wherein the second print means comprises an ink jet printer having an encoder associated therewith for properly spacing the printing on a moving document.

17. The device of claim 1 further comprising sensors for providing failure information to a device control computer along a document path.

18. The device of claim 17 wherein the device control computer does not stop the device from processing documents downstream of a detected failure.

19. The device of claim 1 wherein the stacker includes a stack platen which automatically lowers as the number of documents stacked thereon increases.

20. The device of claim 1 further comprising a bar code reader operatively connected to the print control computer upstream of the print means.

21. A paper processing device for processing original documents with user determinable annotations comprising a document feeder, print means for printing the user determined annotation, an inverter to turn the document onto its first side, and a stacker to stack the printed documents in their original order, wherein the annotation printing is controlled by a print control computer, further comprising a scanner for capturing the image from the document downstream of the print means.

22. The device of claim 21 further comprising a storage medium operatively coupled with the scanner for storing the images scanned.

23. A method of annotating documents comprising the steps of singulating an original document with printing thereon from a stack of original documents, automatically determining whether the document should or should not be annotated, transporting the document past a print means, printing a user determinable annotation on the document passing beneath the print means, inverting the document and transporting the document onto a stack of annotated documents.

* * * * *